US009772133B2

(12) United States Patent
Mackowiak

(10) Patent No.: US 9,772,133 B2
(45) Date of Patent: Sep. 26, 2017

(54) ICE MAKING DEVICE

(71) Applicant: Howe Corporation, Chicago, IL (US)

(72) Inventor: Jeffrey A. Mackowiak, Oak Lawn, IL (US)

(73) Assignee: Howe Corporation, Chicago, IL (US)

( * ) Notice: Subject to any disclaimer, the term of this patent is extended or adjusted under 35 U.S.C. 154(b) by 207 days.

(21) Appl. No.: 14/533,649

(22) Filed: Nov. 5, 2014

(65) Prior Publication Data

US 2016/0123647 A1 May 5, 2016

(51) Int. Cl.

| | |
|---|---|
| ***F25C 1/04*** | (2006.01) |
| ***F25C 5/02*** | (2006.01) |
| ***F25C 1/14*** | (2006.01) |

(52) U.S. Cl.

CPC ..... *F25C 1/04* (2013.01); *F25C 1/145* (2013.01); *F25C 5/02* (2013.01); *F25C 2400/14* (2013.01)

(58) Field of Classification Search

CPC .... F25C 1/04; F25C 1/145; F25C 5/02; F25C 2400/14

See application file for complete search history.

(56) References Cited

U.S. PATENT DOCUMENTS

| | | | | |
|---|---|---|---|---|
| 2,080,639 A | | 5/1937 | Taylor | |
| 2,277,526 A | | 3/1942 | Mojonnier et al. | |
| 2,280,320 A | | 4/1942 | Taylor | |
| 2,307,311 A | | 1/1943 | Vilter et al. | |
| 2,436,439 A | | 2/1948 | Lincoln et al. | |
| 2,504,465 A | | 4/1950 | Sticelber | |
| 2,735,275 A | | 2/1956 | Branchflower | |
| 2,735,591 A | | 2/1956 | Branchflower | |
| 2,860,490 A | * | 11/1958 | Taylor | F25C 1/145 239/222.11 |
| 3,193,272 A | | 7/1965 | Kramer et al. | |
| 3,403,532 A | * | 10/1968 | Knowles | F25C 1/145 62/347 |
| 4,573,329 A | | 3/1986 | Cavalli | |

(Continued)

FOREIGN PATENT DOCUMENTS

JP S51117268 9/1976

OTHER PUBLICATIONS

European Patent Office, Extended European Search Report from corresponding European Application EP15184657.3 , dated Aug. 8, 2016.

(Continued)

*Primary Examiner* — Emmanuel Duke

(74) *Attorney, Agent, or Firm* — Greer, Burns & Crain, Ltd.

(57) ABSTRACT

An ice making device and a method of making ice. A plurality of passages for refrigerant, preferably, multi-component refrigerant, is in thermal communication with a freezing surface, for example in an outer shell surrounding a body. The passages each include an inlet and an outlet. The inlet for a passage may be disposed approximately 180° from the outlet for that passage. The outlet for the passages may form the inlet for the subsequent passage. The size of the outlets may be smaller than a cross-sectional size of the passage. As the refrigerant moves through the passages, water on the freezing surfaces will freeze and form ice. A blade will scrape the ice off.

18 Claims, 3 Drawing Sheets

(56) References Cited

U.S. PATENT DOCUMENTS

| | | | | |
|---|---|---|---|---|
| 4,604,875 | A * | 8/1986 | Keller | F25C 1/145 239/567 |
| 4,760,710 | A | 8/1988 | Takagi | |
| 6,971,245 | B2 | 12/2005 | Kuroyanagi | |
| 8,132,424 | B2 | 3/2012 | Burn | |
| 2001/0045275 | A1 | 11/2001 | Banno et al. | |
| 2010/0064717 | A1 * | 3/2010 | Burn | F25C 1/14 62/353 |
| 2014/0260382 | A1 * | 9/2014 | Yana Motta | C09K 5/045 62/115 |

OTHER PUBLICATIONS

European Patent Office, Partial European Search Report from corresponding European Application EP15184657.3 , dated Feb. 25, 2016.

* cited by examiner

ICE MAKING DEVICE

CROSS-REFERENCES TO RELATED APPLICATIONS

None.

BACKGROUND OF THE INVENTION

The present invention relates to an ice making device, and more particularly to an ice making device that produces flaked or shaved ice, as well as a process for making ice.

Ice is commonly produced by application of water onto one or more freezing surfaces of a drum. A refrigerant is provided to the drum and is in thermal contact with the one or more surfaces. As the refrigerant absorbs heat from the water, the water will freeze on the surfaces forming an ice film. The ice film thickness and ice production rate can be determined by several variables including but not limited to, the water application rate, rotation speed, and the rate at which the refrigerated surface absorbs the heat from the water as ice is formed.

An ice removal blade can rotate along and score, or otherwise scrape, the ice to remove the ice from the refrigerated surface and clear the surface. The separated ice may fall out of the bottom of the drum. Water can be applied to the freshly cleared surface, starting the process all over again. Thus, the device can continuously produce ice, which is beneficial and desirable in many commercial and industrial applications.

As mentioned above, in order to freeze the water, refrigerant is provided to the drum, typically in a shell. The shell can comprise a flooded design (wherein the space is entirely filled with refrigerant) or a circuited design (wherein the space includes one or more flow paths for the refrigerant). It is believed that the circuit design is more advantageous to the flooded design because of greatly reduced refrigerant inventory and more simple piping and controls.

With the advent of multi-component high temperature glide refrigerants, (such as R-407a, R-407f, and the like), it is believed that the conventional evaporator designs fail to fully utilize the heat absorption capacity of these refrigerants. Additionally, flooded evaporators are not well suited to work with high temperature glide refrigerants due to the fractionation of the components of refrigerant blends.

Therefore, it would be desirable to have an ice making device that fully accommodates the multi-component refrigerants.

Additionally, it would be desirable for such a device to work with single component refrigerants and relatively low temperature glide refrigerants.

SUMMARY OF THE INVENTION

A new ice making device and a method for producing ice have been invented.

In one aspect of the present invention, the invention provides an ice making device comprising a hollow cylindrical body having an inner surface and an outer surface and an outer shell substantially surrounding the hollow cylindrical body. The cylindrical body is typically arranged with the axis of the cylinder in a vertical orientation during use. The outer shell comprises a plurality of passages for refrigerant, each passage including an inlet and an outlet, and the outlet for each passage being disposed approximately 180 degrees about the hollow cylindrical body from the inlet for that passage. The passages may be arranged generally horizontal when the cylindrical body is oriented with its axis vertical. The ice making device also includes a water distributor configured to convey water to the inner surface of the cylindrical body and, a blade configured to remove ice from the inner surface of the hollow cylindrical body.

In some embodiments of the present invention, each passage from the plurality of passages comprises a ring. It is contemplated that the outlet of a first ring comprises the inlet of a second ring.

In at least one embodiment, each passage includes a cross-sectional size when viewed along a flow path through that passage. The outlet of that passage has a smaller size than the cross-sectional size of that passage.

In one or more embodiments of the present invention, an inlet for a first passage from the plurality of passages comprises an inlet for the outer shell and wherein an outlet for a second passage from the plurality of passages comprises an outlet for the outer shell.

In some embodiments of the present invention, the ice making device further utilizes a multi-component refrigerant and a vapor compression refrigeration system. It is contemplated that the multi-component refrigerant has a glide of at least 4° F. for a given evaporator pressure.

In a second aspect of the present invention, the present invention provides an ice making device comprising a hollow body having a top, a bottom, and a side wall with an inner surface and an outer surface. The device further comprises an outer shell including an inlet for refrigerant and an outlet for refrigerant. The outer shell substantially surrounds the body and comprises a plurality of passages for refrigerant. Each passage includes an inlet, an outlet, and at least two flow paths for refrigerant. Each flow path extends from the inlet of the passage to the outlet of the passage. The outlet for an uppermost passage comprises the inlet for an immediately subsequent passage. The inlet for a lowermost passage comprises the outlet of an immediately preceding passage. The device further includes a water distributor configured to convey water onto the inner surface of the wall, and, a blade configured to remove ice from the inner surface of the wall such that ice is capable of passing out of the bottom of the body.

In some embodiments of the present invention, the hollow body may comprise a cylindrical shape.

In some embodiments of the present invention, the inlet for the uppermost passage comprises an inlet for the outer shell and the outlet for the lowermost passage comprises an outlet for the outer shell.

In at least one embodiment of the present invention, the inlet of each passage between the uppermost passage and the lowermost passage comprises the outlet of an immediately preceding passage.

In some embodiments of the present invention, each passage comprises a cross-sectional size when viewed along one of the flow paths of that passage. The outlet of each passage has a smaller size than the cross-sectional size of that passage.

In at least one embodiment of the present invention, the ice making device further includes a refrigerant, a vapor compression refrigeration system a first line configured to pass the refrigerant from the vapor compression refrigeration system to the outer shell, and, a second line configured to pass the refrigerant from the outer shell to the vapor compression refrigeration system. It is contemplated that the refrigerant comprises a multi-component refrigerant having a glide of at least 4° F.

In still another aspect of the present invention, the invention provides an ice making device comprising a body having a top, a bottom, and a wall with a freezing surface. A plurality of passages for refrigerant are in thermal communication with the freezing surface. Each passage includes an inlet, an outlet. At least two passages from the plurality of passages comprises a cross-sectional size when viewed along a flow path through that passage, and wherein the outlet of that passage has a smaller size than the cross-sectional size of that passage. The device further comprises a water distributor configured to convey water onto the freezing surface of the wall and a blade configured to remove ice from the freezing surface of the wall.

In at least one embodiment of the present invention, at least one passage comprises at least two flow paths for refrigerant.

In some embodiments of the present invention, the body comprises a hollow body.

In one or more embodiments of the present invention, the body comprises a planar body.

In various embodiments of the present invention, the ice making device further comprises a refrigerant, a vapor compression refrigeration system, a first line configured to pass the refrigerant from the vapor compression refrigeration system to the passages, and a second line configured to pass the refrigerant from the passages to the vapor compression refrigeration system.

It at least one embodiment of the present invention, the refrigerant comprises a multi-component refrigerant having a glide of at least 4° F.

In yet another aspect of the present invention, the present invention provides a process for producing ice by: passing a refrigerant into a shell having a plurality of passages, each passage comprising a hollow ring, and the shell having an wall in thermal contact with an inner surface of a body; passing a first portion of the refrigerant in a first direction from an inlet of a first ring to an outlet of the first ring; passing a second portion of the refrigerant in a second direction from the inlet of the first ring to the outlet of the first ring, the second direction being different than the first direction; conveying water on the surface of the body; and, transferring heat from the water to the refrigerant to form ice.

In some embodiments, the process also includes scoring the ice to form flaked ice.

In at least one embodiment, the process also includes passing the refrigerant to a second ring, wherein an inlet for the second ring comprises the outlet for the first ring. It is contemplated that the inlet for the second ring is disposed 180 degrees about the hollow ring from the inlet of the first ring. It is also contemplated that the inlet for the second ring and the inlet for the first ring each have a size that is smaller than a cross-sectional size of the first ring when viewed along one of the flow paths of the first ring.

In at least one embodiment, the refrigerant comprises a multi-component refrigerant having a glide of at least 4° F.

In some embodiments, the process also includes compressing the refrigerant in a vapor compression refrigeration system, and, passing the refrigerant from the vapor compression refrigeration system to the shell. It is further contemplated that the process includes passing a compressed refrigerant from a compressor, through a condenser, then through an expansion device, then to the shell.

These and other aspects and embodiments of the present invention will be appreciated by those of ordinary skill in the art based upon the following description of the drawings and detailed description of the preferred embodiments.

BRIEF DESCRIPTION OF THE DRAWINGS

The figures in the appended drawing will make it possible to understand how the invention can be produced. In these figures, identical reference numbers denote similar elements.

DETAILED DESCRIPTION OF THE PREFERRED EMBODIMENTS

As mentioned above, a new ice making device and a method for making ice have been invented. In a most preferred embodiment, the device and method both generally utilize a shell surrounding an inner cylinder. Refrigerant is circulated between a vapor compression refrigeration system and the shell. The outer shell includes a series of sequential passageways for the refrigerant. The passageways are configured such that the refrigerant is subjected to turbulence and localized pressure drop as the refrigerant moves to each subsequent ring via each passage. While this is believed to be useful for all types of refrigerants, it is believed to be especially useful for multi-component refrigerants. While not intending to be bound by any particular theory, it is believed that by providing a more "torturous" path for the refrigerant to travel, the refrigerant is able to absorb more heat thus increasing heat transfer efficiency and provide more ice at a prescribed evaporator temperature. Additionally, by providing turbulence, it is believed that the individual components in a multi-component refrigerant are more likely to remove heat. Again, this is believed to allow for ice with a lower temperature, which, as will be appreciated, will stay frozen longer and thus providing a more efficient production of ice and thus an increase in ice making capacity for a given freezing surface area.

Accordingly, with reference the attached drawings, one or more embodiments of the present invention will now be described with the understanding that the described embodiments are merely preferred and are not intended to be limiting.

Figure 1:
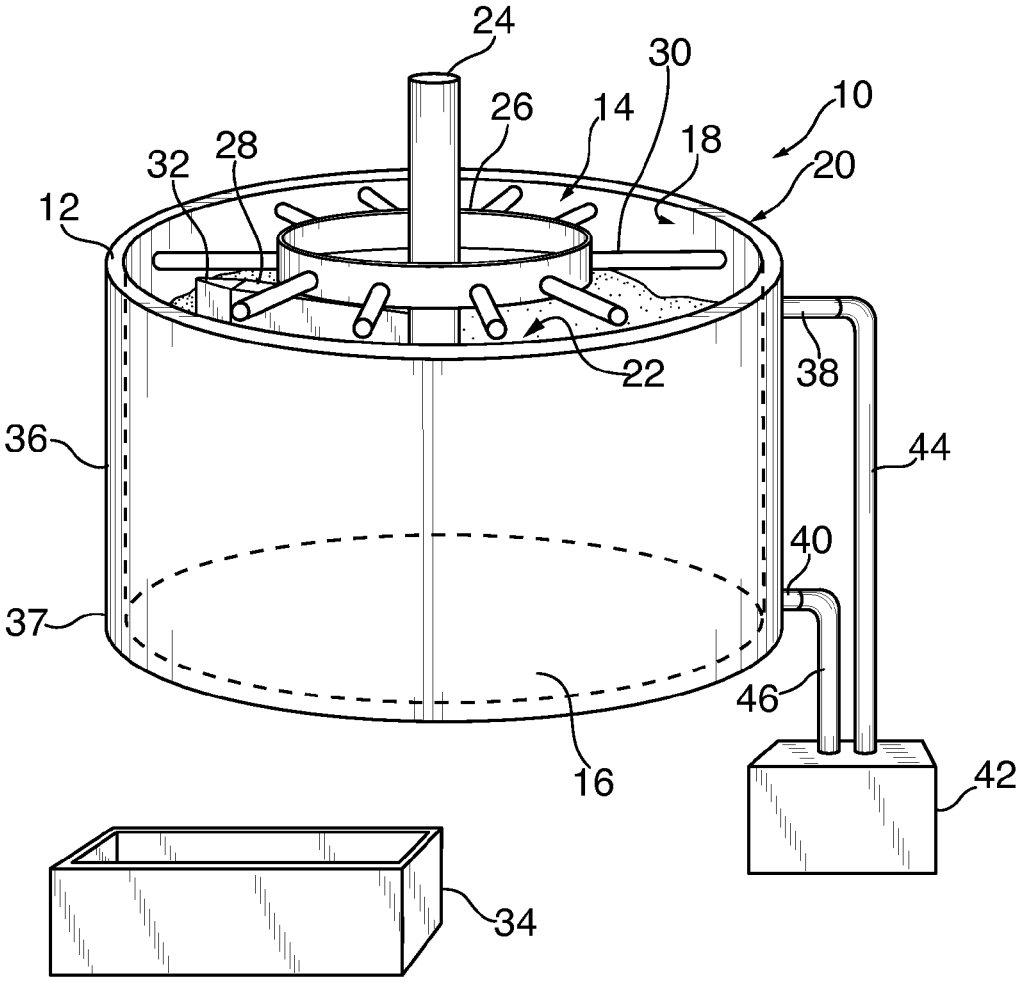
FIG. 1 is a top and side perspective view of an ice making device according to one or more embodiments of the present invention.

As shown in FIG. 1, a device 10 according to one or more embodiments of the present invention includes a hollow body 12, preferably having a cylindrical shape and arranged during use with its axis in a substantially vertical orientation. While the body is described and depicted as having a cylindrical shape, other shapes are also contemplated to be used with the present invention, for example, square, rectangular, and the like. Additionally, although not depicted as such, a horizontal orientation may also be used. The hollow body 12 includes an open top end 14, an open bottom end 16, an inner surface 18, and an outer surface 20.

Extending partially into a cavity 22 of the hollow body 12 is a rotatable shaft 24 with an arm 28. A water pan 26 includes a plurality of water distributors 30 which convey water onto the inner surface 18 of the hollow body 12. As will be appreciated, the water pan 26 is in communication with a water reservoir or other water supply (not shown). The arm 28 comprises a blade 32 which will score or scrape ice off of the inner surface 18 as the shaft 24 rotates. In order to rotate the arm 28 and the water dispensers 30, the shaft 24 may be driven by a motor (not shown).

The device 10 can be mounted on top of a housing with a drawer or other container 34 below the hollow body 12 to collect the ice that passes out of the bottom end 16 of the hollow body 12. These components are known in the industry to those of ordinary skill in the art.

Substantially surrounding the hollow body 12 is an outer shell 36. The outer shell 36 includes an inlet 38 for receiving refrigerant, and an outlet 40 for recovering refrigerant from the outer shell 36. The refrigerant may be passed to the outer shell 36 from a vapor compression refrigeration system 42 via a line 44 and, likewise, returned from the outer shell 36 to the vapor compression refrigeration system 42 via a line 46 (after the refrigerant has expanded and evaporated in the outer shell 36). As would be appreciated to those of ordinary skill in the art, the vapor compression refrigeration system 42 typically includes, a condenser, an expansion device, a compressor, and a pressure regulator (not shown). In some embodiments of the present invention, the vapor compression refrigeration system 42 is shared with other equipment, while in other embodiments, the vapor compression refrigeration system 42 is part of a self-contained ice making device. As will be appreciated, these differences can be due to the size of the device 10, the vapor compression refrigeration system 42, and energy concerns.

Thus, the outer shell 36 acts as an evaporator wherein, as the refrigerant expands and evaporates, heat is absorbed by the refrigerant, thereby reducing the temperature of the inner surface 18 and the outer surface 20 of the hollow body 12. Additionally, as is known, an insulation layer (not shown) may surround an outside surface 37 of the outer shell 36 to maximize the energy efficiency of the device.

It is also contemplated that water distributors 30 are configured to convey water onto the outside surface 37 of the outer shell 36. This can be done in addition to water being conveyed onto the inner surface 18 of the hollow body 12 or in the alternative to the water being conveyed onto the inner surface 18. If both the inner surface 18 of the hollow body 12 and the outer surface 37 of the outer shell 36 are used to produce ice, both will comprise freezing surfaces of the device 10. Accordingly, although not depicted as such, the blade 32 could be configured to remove ice from the outer surface 37 of the outer shell 36 as well.

Figure 2:
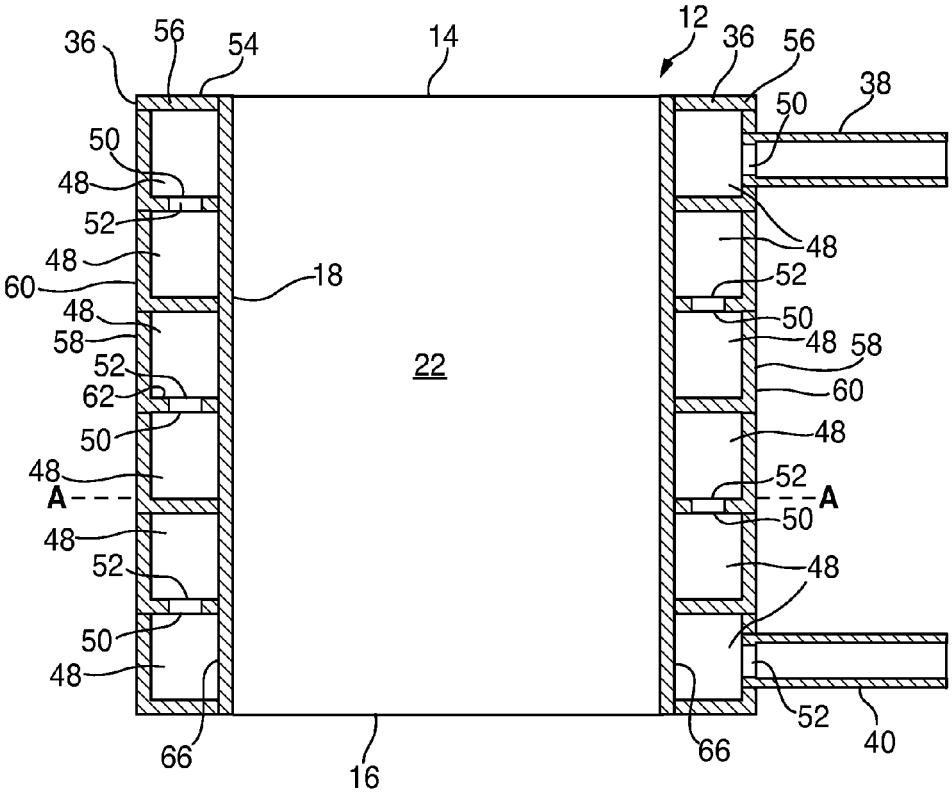
FIG. 2 is a side cross sectional view of a portion of an ice making device according to one or more embodiments of the present invention.

Turning to FIG. 2, the outer shell 36 comprises a plurality of passages 48 for the refrigerant. Each passage 48 includes an inlet 50 and an outlet 52. At least one passage 48, preferably an uppermost passage, has an inlet 50 that comprises the inlet 38 for the outer shell 36, and at least one passage 48, preferably a lowermost passage, has an outlet 52 that comprises the outlet 40 for the outer shell 36. Thus, in this configuration, refrigerant will flow from the top down. Other configurations are also contemplated, for example, bottom up or both.

In an embodiment, a top 54 of the outer shell 36 comprises a flat ring 56. The passages 48 are manufactured from stock metal rings 58 with an L-shaped profile (with an outer wall 60 and a bottom wall 62). The bottom wall 62 may be welded or otherwise secured to the hollow body 12. The outer wall 60 may be welded or otherwise secured to a ring 58 above (or below) that ring 58 (or it may be welded to the flat ring 56 at the top 56 of the outer shell 36 depending on the position of the ring 58). An inner wall 66 of the passage is formed by the outer surface 20 of the hollow body 12. This configuration and arrangement is merely preferred, and other configurations could be utilized.

Figure 3:
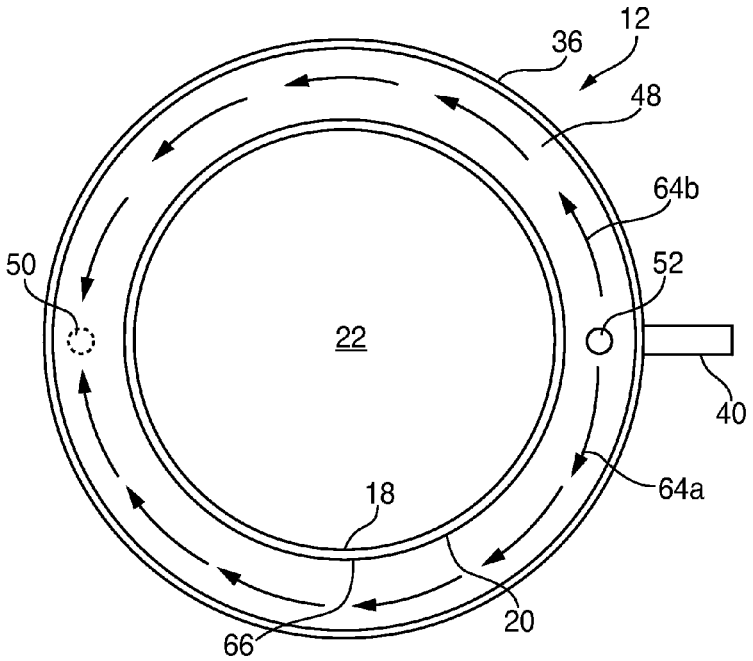
FIG. 3 is a top cross sectional view of the refrigerated portion of the ice making device of FIG. 2 taken along line A-A in FIG. 2.

As can be seen in FIGS. 2 and 3, the outlet 52 for each passage 48 is disposed approximately 180° around the hollow body 12 from the inlet 50 of that passage 48. Additionally, the outlets 52 of the passages 48 (with the exception of the passage 48 with the outlet 40 for the outer shell 36) are formed by the inlet 50 of the immediately preceding passage 48. Similarly, the inlets 50 of the passages 48 (with the exception of the passage 48 with the inlet 38 for the outer shell 36) are formed by the outlet 52 of the immediately following ring 58.

With reference to FIG. 3, each passage 48 (or ring 58) will include at least two flow paths 64*a*, 64*b* for refrigerant from the inlet 50 to the outlet 52 within each passage 48. More particularly, one flow path 64*a* will be in a clockwise direction (relative to FIG. 3) and the other flow path 64*b* will be in a counterclockwise direction (relative to FIG. 3). This split flow path designed is believed to create turbulence in the passage 48 for the refrigerant. By creating turbulence, such a design is believed to allow for the efficient usage of multi-component refrigerants and especially multiple component refrigerants with at least a 4° F. glide.

Additionally, as can be seen in FIG. 2, it is preferred that when viewed along a flow path of a passage 48 (running into and out of the paper for FIG. 2), the passage 48 has a cross-sectional size. It is preferred that a size of the outlet 52 (i.e., the area of the opening or aperture that refrigerant flows through) for that passage 48 is smaller than the cross-sectional size of that passage 48. Surprisingly, very little pressure drop has been observed in such a design.

A method of making ice will now be described in reference to the drawings discussed above, with the understanding that the reference is merely exemplary in nature.

Refrigerant, preferably, a multiple component refrigerant with at least a 4° F. glide, is passed from the vapor compression refrigeration system 42 into the outer shell 36 which has a plurality of passages 48. The inner wall 66 of the outer shell 36 is in thermal communication with the inner surface 18 of the hollow body 12. Within each passage 48, a first portion of the refrigerant will travel in a first flow path 64*a*, and a second portion of the refrigerant will travel in a second flow path 64*b*, different than the first flow path 64*a*. Both of the flow paths 64*a*, 64*b* will begin at the inlet 50 for the passage 48 and end at the outlet 52 for the passage 48.

The refrigerant will continue in the same manner through the successive passages 48 until the refrigerant is recovered from the outer shell 36. The refrigerant may be compressed and recycled back to the outer shell 36.

A motor (not shown) rotates shaft 24 so that the water dispenser 30 conveys water onto the inner surface 18 of the hollow body 12 throughout its circumference. As the refrigerant is flowing throughout the passages 48 of the outer shell 36, the refrigerant will absorb heat from water on the freezing surfaces of the device, for example, the inner surface 18 of the hollow body 12. This will cause the water to freeze. The arm 28 on the shaft 24 also rotates and the blade 32 scores the newly formed ice on the inner surface 18. The ice will fall off the inner surface 18, can pass out of the bottom end 16 of the hollow body 12 via gravity, and can be collected in the container 34.

The ice will preferably have a lower temperature than 32° F., which will allow it to stay frozen longer. Since the ice is typically collected in a reservoir and used on an "as needed" basis, the ability to provide longer lasting ice will be more efficient and cost effective.

Figure 4:
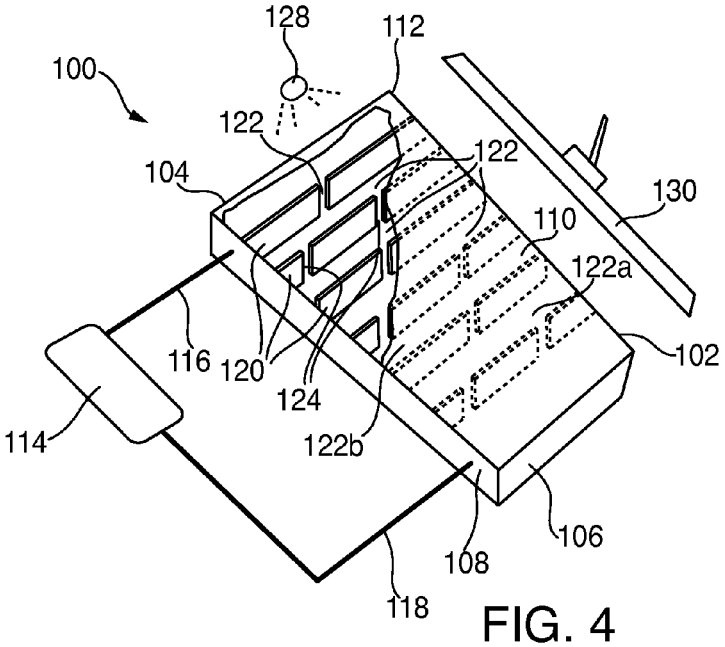
FIG. 4 is a perspective elevation view, partially cutaway, of another ice making device according to one or more embodiments of the present invention.

As shown in FIG. 4, another ice making device is shown in which the ice making device 100 comprises a body 102 that is relatively planar, or flat. The body includes a top 104, a bottom 106 and a sidewall 108. As shown, an outer surface 112 of the sidewall 108 comprises a freezing surface 110. Refrigerant is supplied to the body 102 from a compressor 114 in a first line 116 and passed from the body 102 to the compressor 114 in a second line 118.

Within the body 102, a plurality of baffles 120 create a plurality of passages 122 for the refrigerant. The baffles 120 create an inlet 124 for the passages 122 and an outlet 126 for the passages 122 with at least one flow path from the inlet 124 to the outlet 126 for each passage 122. As shown, the passages 122 alternate between a passage with two flow paths that diverge, for example, passage 122*a*, and a passage with two flow paths that converge, for example passage 122*b*, such that the flow for the refrigerant changes direction a plurality of times within the body 102.

Each passage 122 comprises a cross-sectional size when viewed along a flow path through that passage 122. Preferably, the outlet 126 of that passage 122 has a smaller size than the cross-sectional size of that passage 122.

The passages 122 within the body 102 are in thermal communication with the freezing surface 110. A water distributor 128 can convey water upon the freezing surface 110. If the body 102 is angled so that the top 104 is higher than the bottom 106, the water will flow downward along the freezing surface 110 until the water freezes (because the refrigerant has absorbed the heat from the water). A blade 130 can then scrape the ice off of the freezing surface 110. Although the blade 130 is shown traveling across the freezing surface 110 from side to side, the blade 130 could also move top 104 to bottom 106, or in other directions as well.

By using the split flow path configuration, the smaller size of the outlets 52, 126 compared to the cross sectional size of the passages 48, 122, or both, a device according to one more embodiments of the present invention is believed to also provide ice having a lower temperature, allowing the ice to remain frozen longer.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The invention claimed is:

1. An ice producing device comprising:

a hollow body having at least one freezing surface;

a plurality of passages for refrigerant in thermal communication with each freezing surface, each passage including an inlet and an outlet, wherein the outlet for each passage is disposed approximately 180 degrees about the hollow body from the inlet for that passage;

a water distributor configured to provide water to the freezing surface; and, a blade configured to remove ice from the freezing surface, and, wherein at least one passage has two flow paths from the inlet of that passage to the outlet of the passage.

2. The ice producing device of claim 1 wherein each passage from the plurality of passages comprise a ring.

3. The ice producing device of claim 2 wherein the outlet of a first ring comprises the inlet of a second ring.

4. The ice producing device of claim 1 wherein each passage comprises a cross-sectional size when viewed along a flow path through that passage, and wherein the outlet of that passage has a smaller size than the cross-sectional size of that passage.

5. The ice producing device of claim 1 wherein an inlet for a first passage from the plurality of passages comprises an inlet for an outer shell and wherein an outlet for a second passage from the plurality of passages comprises an outlet for the outer shell.

6. The ice producing device of claim 1 further comprising:

a multi-component refrigerant; and, a vapor compression refrigeration system in communication the plurality of passages.

7. The ice producing device of claim 1, wherein the multi-component refrigerant has a glide of at least 4° F.

8. An ice producing device comprising:

a body having a top, a bottom, and at least one freezing surface;

a plurality of ring-shaped passages for refrigerant, each ring-shaped passage including an inlet, an outlet, and wherein at least two ring-shaped passages from the plurality of ring-shaped passages comprises a cross-sectional size when viewed along a flow path through that ring-shaped passage, and wherein the outlet of that ring-shaped passage has a smaller size than the cross-sectional size of that ring-shaped passage, and wherein the ring-shaped passages are in thermal communication with each freezing surface, and wherein at least one ring-shaped passage comprises at least two flow paths for refrigerant;

a water distributor configured to convey water onto the at least one freezing surface; and, at least one blade configured to remove ice from the at least one freezing surface.

9. The ice producing device of claim 8 wherein the body comprises a hollow body.

10. The ice producing device of claim 8 further comprising:

a refrigerant;

a vapor compression refrigeration system;

a first line configured to pass the refrigerant from the vapor compression refrigeration system to the ring-shaped passages; and, a second line configured to pass the refrigerant from the passages to the vapor compression refrigeration system.

11. The ice producing device of claim 10, wherein the refrigerant comprises a multi-component refrigerant having a glide of at least 4° F.

12. A process for producing ice comprising:

passing a refrigerant into a plurality of passages, each passage comprising a hollow ring, and each passage having a wall in thermal communication with at least one freezing surface of a body;

wherein a first portion of the refrigerant flows in a first direction from an inlet of a first ring to an outlet of the first ring;

wherein a second portion of the refrigerant flows in a second direction from the inlet of the first ring to the outlet of the first ring, the second direction being different than the first direction;

conveying water on the at least one freezing surface of the body; and, transferring heat from the water to the refrigerant to form ice.

13. The process of claim 12 further comprising:

scoring the ice to form flaked ice.

14. The process of claim 12 further comprising:

passing the refrigerant from the first ring to a second ring, wherein an inlet for the second ring comprising the outlet for the first ring.

15. The process of claim 14 wherein the inlet for the second ring is disposed 180 degrees about the hollow ring from the inlet of the first ring.

16. The process of claim 14 wherein the inlet for the second ring and the inlet for the first ring have a size that is smaller than a cross-sectional size of the first ring when viewed along the first direction.

17. The process of claim 12 wherein the refrigerant comprises a multi-component refrigerant having a glide of at least 4° F.

18. The process of claim 12 further comprising:

compressing the refrigerant in a vapor compression refrigeration system; and, passing the refrigerant from the vapor compression refrigeration system to the plurality of passages.

* * * * *